US006826792B2

(12) United States Patent
Lin

(10) Patent No.: US 6,826,792 B2
(45) Date of Patent: Dec. 7, 2004

(54) AIR MATTRESS HAVING TEMPERATURE REGULATOR

(76) Inventor: Jeng Ming Lin, P.O. Box 63-298, Taichung (TW), 406

( * ) Notice: Subject to any disclaimer, the term of this patent is extended or adjusted under 35 U.S.C. 154(b) by 30 days.

(21) Appl. No.: 10/404,595

(22) Filed: Mar. 29, 2003

(65) Prior Publication Data

US 2004/0187216 A1 Sep. 30, 2004

(51) Int. Cl.[7] ..... A47C 21/04

(52) U.S. Cl. ..... 5/421; 5/284; 5/423; 62/261; 219/217

(58) Field of Search ..... 5/284, 655.2, 423, 5/421, 713, 726; 219/217; 62/261

(56) References Cited

U.S. PATENT DOCUMENTS 4,777,802 A * 10/1988 Feher ..... 62/3.3
5,448,788 A * 9/1995 Wu ..... 5/421
5,555,579 A * 9/1996 Wu ..... 5/421
6,546,576 B1 * 4/2003 Lin ..... 5/423
2003/0070235 A1 * 4/2003 Suzuki et al. ..... 5/658

* cited by examiner

*Primary Examiner*—Michael F. Trettel

(57) ABSTRACT

An air mattress device includes an air mattress member, and a temperature regulator coupled to the air mattress member with a hose, to supply the regulated air into the air mattress member via the hose. The temperature regulator includes a casing disposed in a housing, a heat exchanging member disposed in the casing, to exchange heat with the air flowing into the casing. A heat dissipating device is disposed in the housing, a heat exchanger includes two conductors disposed between the heat dissipating device and the casing, to transmit heat between the heat dissipating device and the casing.

6 Claims, 10 Drawing Sheets

AIR MATTRESS HAVING TEMPERATURE REGULATOR

BACKGROUND OF THE INVENTION

1. Field of the Invention

The present invention relates to an air mattress, and more particularly to an air mattress assembly having a temperature regulator for adjusting the temperature of the air that may flow into the air mattress member.

2. Description of the Prior Art

Various kinds of typical air mattresses have been developed, and comprise a hollow interior to receive air therein, and to resiliently and comfortably support the users.

Normally, the air in the environment or the air having a room temperature is supplied into the typical air mattresses, and may not be adjusted to different temperatures, such that the typical air mattresses also may not be adjusted to different temperatures.

In addition, the typical air mattresses are normally made of plastic materials or the other synthetic materials. The users may feel hot when supported on the typical air mattresses that are made of plastic materials or the other synthetic materials, and the users may feel uncomfortable.

The present invention has arisen to mitigate and/or obviate the afore-described disadvantages of the conventional air mattresses.

SUMMARY OF THE INVENTION

The primary objective of the present invention is to provide an air mattress assembly including a temperature regulator for adjusting the temperature of the air that flows into the air mattress member, and for allowing the air mattress member to comfortably support the users.

In accordance with one aspect of the invention, there is provided an air mattress assembly comprising an air mattress member, and a temperature regulator coupled to the air mattress member with a hose, to regulate air and to supply the regulated air into the air mattress member via the hose, the temperature regulator including a housing having a partition attached therein to separate the housing into an upper chamber and a lower chamber, a casing disposed in the lower chamber of the housing, and including a pipe coupled to the casing to supply air into the casing and to allow the air to flow out of the casing via the hose, and a heat exchanging member disposed therein, to exchange heat with the air flowing into the casing, a heat dissipating device disposed in the upper chamber of the housing, a heat exchanger including two conductors disposed between the heat dissipating device and the casing, to transmit heat between the heat dissipating device and the casing, and a fan device disposed in the upper chamber of the housing, to generate and blow air through the heat dissipating device.

The heat exchanging member includes a plurality of fins disposed in the casing. The fins are preferably arranged in a zigzag-like air passage in the casing.

Alternatively, the heat exchanging member includes a plurality of posts disposed in the casing. Further alternatively, the heat exchanging member includes a plurality of boards disposed in the casing and each having a plurality of apertures formed therein.

Further alternatively, the heat exchanging member includes a manifold disposed in the casing, and coupled between the pipe and the hose. The housing includes a conductor plate disposed therein and having a recess formed therein to receive the conduit.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
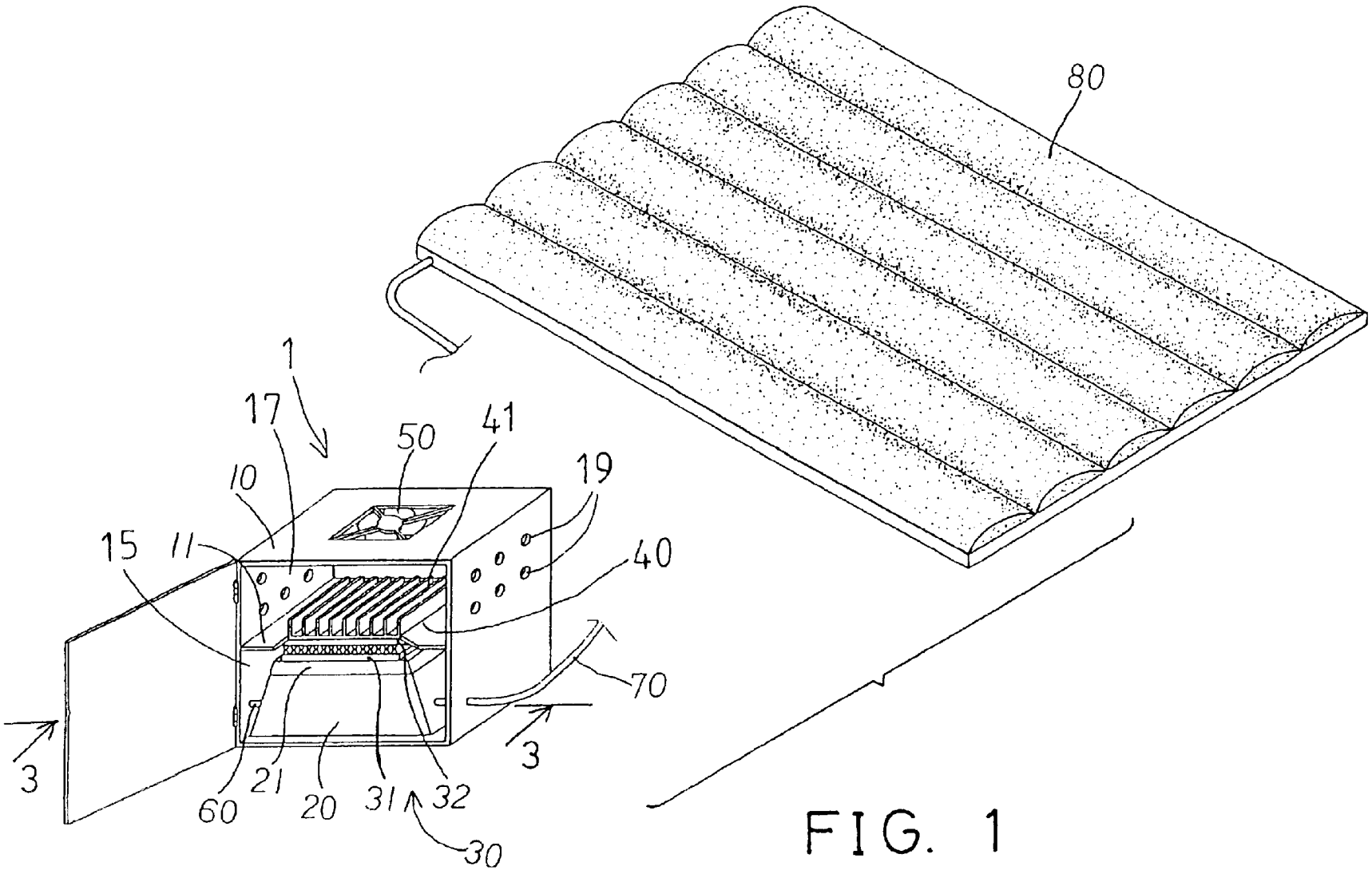
FIG. 1 is a partial exploded view of an air mattress assembly having a temperature regulator in accordance with the present invention, for adjusting the temperature of the air that flows into the air mattress member.
Figure 2:
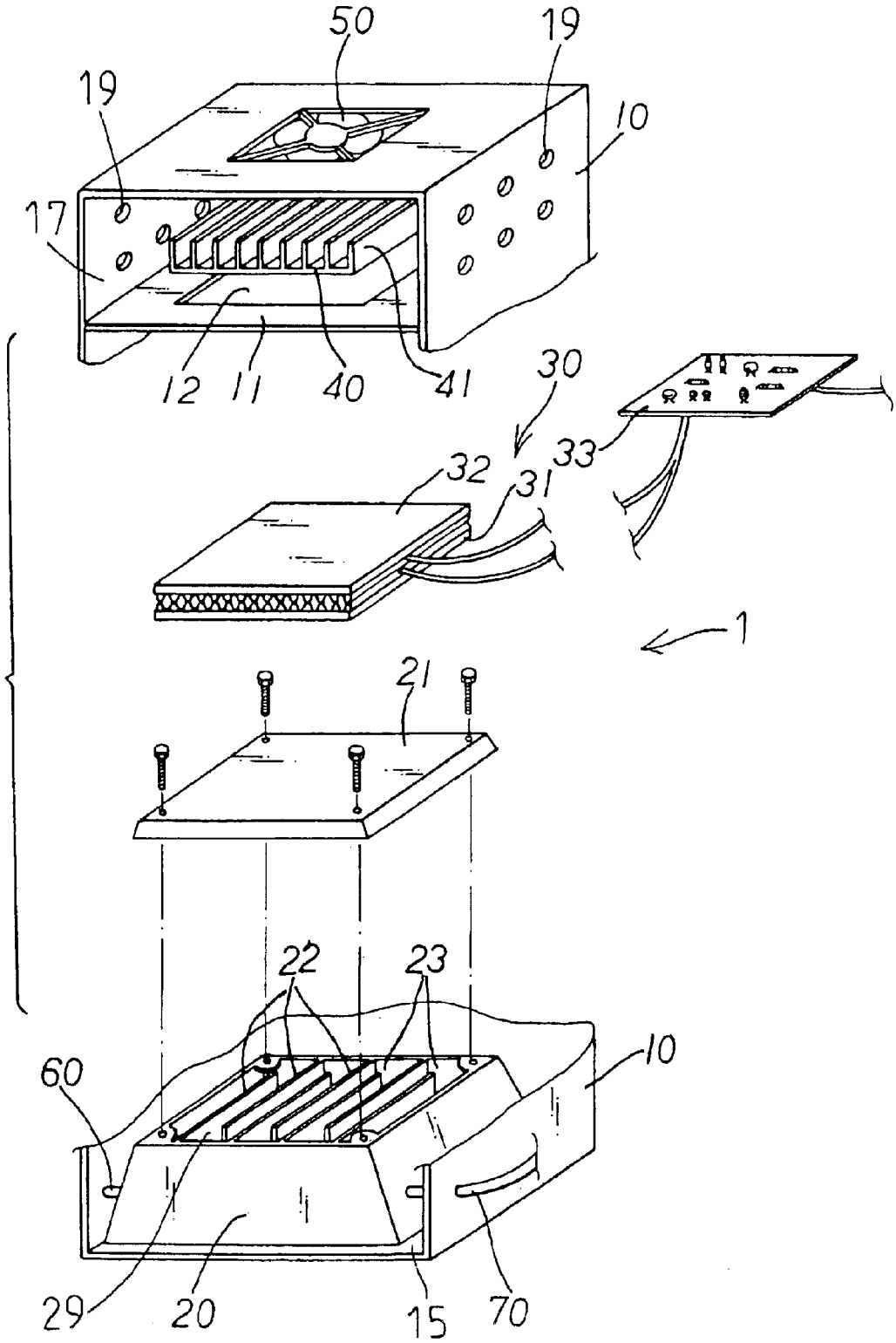
FIG. 2 is a partial exploded view of the temperature regulator for the air mattress.
Figure 3:
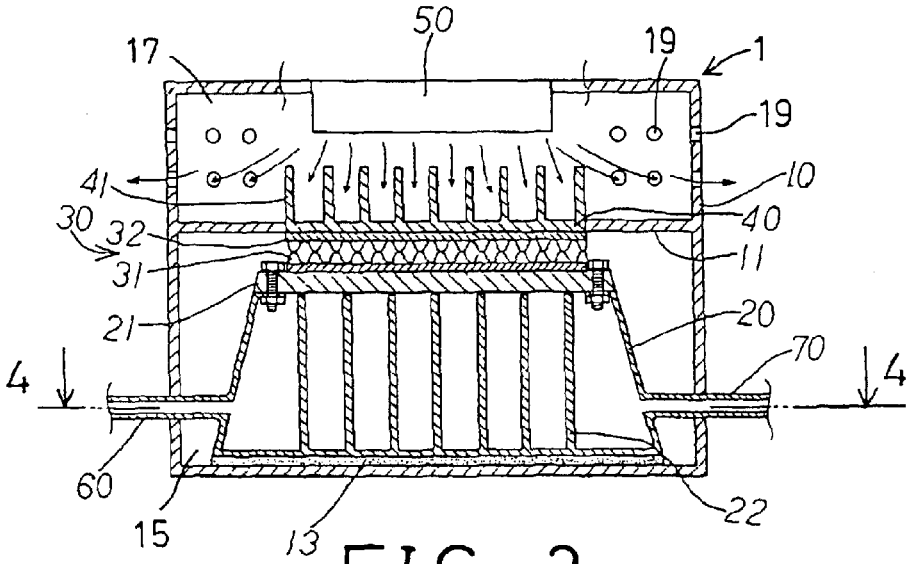
FIG. 3 is a cross sectional view taken along lines 3—3 of FIG. 1.
Figure 4:
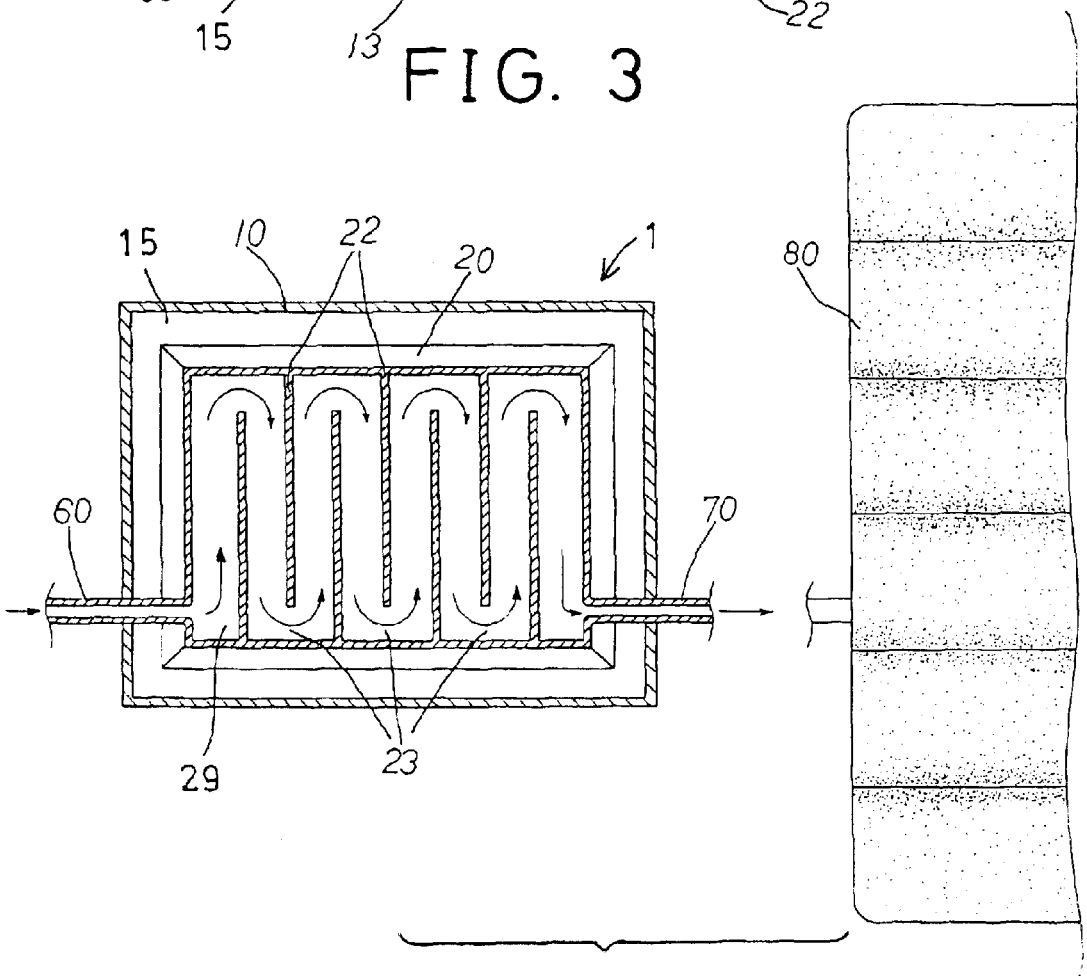
FIG. 4 is a cross sectional view taken along lines 4—4 of FIG. 3.

Referring to the drawings, and initially to FIGS. 1–4, an air mattress assembly in accordance with the present invention comprises a temperature regulator 1 including a hose 70 coupling to an air mattress member 80, for supplying regulated air into the air mattress member 80, and for allowing the air mattress member 80 to comfortably support the users.

The temperature regulator 1 includes a housing 10 having a shelf or a partition 11 attached to the middle portion thereof, to separate the inner portion of the housing 10 into a lower chamber 15 and an upper chamber 17. The partition 11 includes an opening 12 formed therein to receive a heat dissipating device 40 therein which includes a number of fins 41 extended therefrom for heat dissipating purposes.

The housing 10 may further include a spongy or resilient layer 13 applied to the bottom thereof, for preventing heat from being dissipated via the bottom of the housing 10, or for cushioning purposes, or for noise-reducing purposes. The housing 10 may further include a number of orifices 19 formed therein, for air circulation and for heat dissipating purposes.

A casing 20 is provided and disposed in the lower chamber 15 of the housing 10, and preferably disposed or supported on the spongy or resilient layer 13 (FIG. 3), and includes a cover 21 secured on top thereof, and includes a number of heat exchanging members, such as flaps 22 disposed in the inner space 29 thereof. The flaps 22 are disposed in a stagger way to form a number of gaps or a zigzag-like air passage 23 therein.

The hose 70 is coupled to the inner space 29 of the casing 20, and coupled to the air mattress member 80, for allowing the air in the inner space 29 of the casing 20 to be supplied into the air mattress member 80. A pipe 60 is coupled to the casing 20, such as coupled to the inlet of the casing 20, for supplying air into the casing 20.

For example, the pipe 60 may be coupled to an air reservoir (not shown), or a fan device (not shown) may further be provided and coupled to the pipe 60, for supplying air into the casing 20 via the pipe 60. The air supplied into the casing 20 may then be supplied into the air mattress member 80 via the hose 70.

A heat exchanger 30 includes two semi-conductor chips or conductors 31, 32 disposed between the heat dissipating device 40 and the cover 21 of the casing 20, to transmit heat between the heat dissipating device 40 and the casing 20, and includes a processor device or a control circuit board 33 coupled to the conductors 31, 32, to process or control the conductors 31, 32.

In operation, the conductor 31 which is engaged onto the cover 21 of the casing 20 may absorb the heat from the casing 20, and may transmit the heat to the other conductor 32, the conductor 32 may then transmit the heat to the heat dissipating device 40. A fan device 50 may be attached to the upper portion of the housing 10, to generate air and to circulate the air through the fins 41 of the heat dissipating device 40, and to force or blow the air out through the orifices 19 of the housing 10.

The temperature in the casing 20 may thus be decreased, because the heat of the casing 20 may be absorbed by the conductor 31, and may then be transmitted to the other conductor 32 and then to the heat dissipating device 40, and the fan device 50 may blow or dissipate the heat of the conductor 32 and the heat dissipating device 40, such that the air flowing through the air passage 23 of the casing 20 may also be cooled to lower temperature and may then be supplied to the air mattress member 80 via the hose 70.

It is to be noted that the temperature regulator 1 may be easily installed or coupled to the electric power supply of the family buildings or houses, in order to suitably and easily and readily supply the cooler air into the air mattress member 80.

Figure 5:
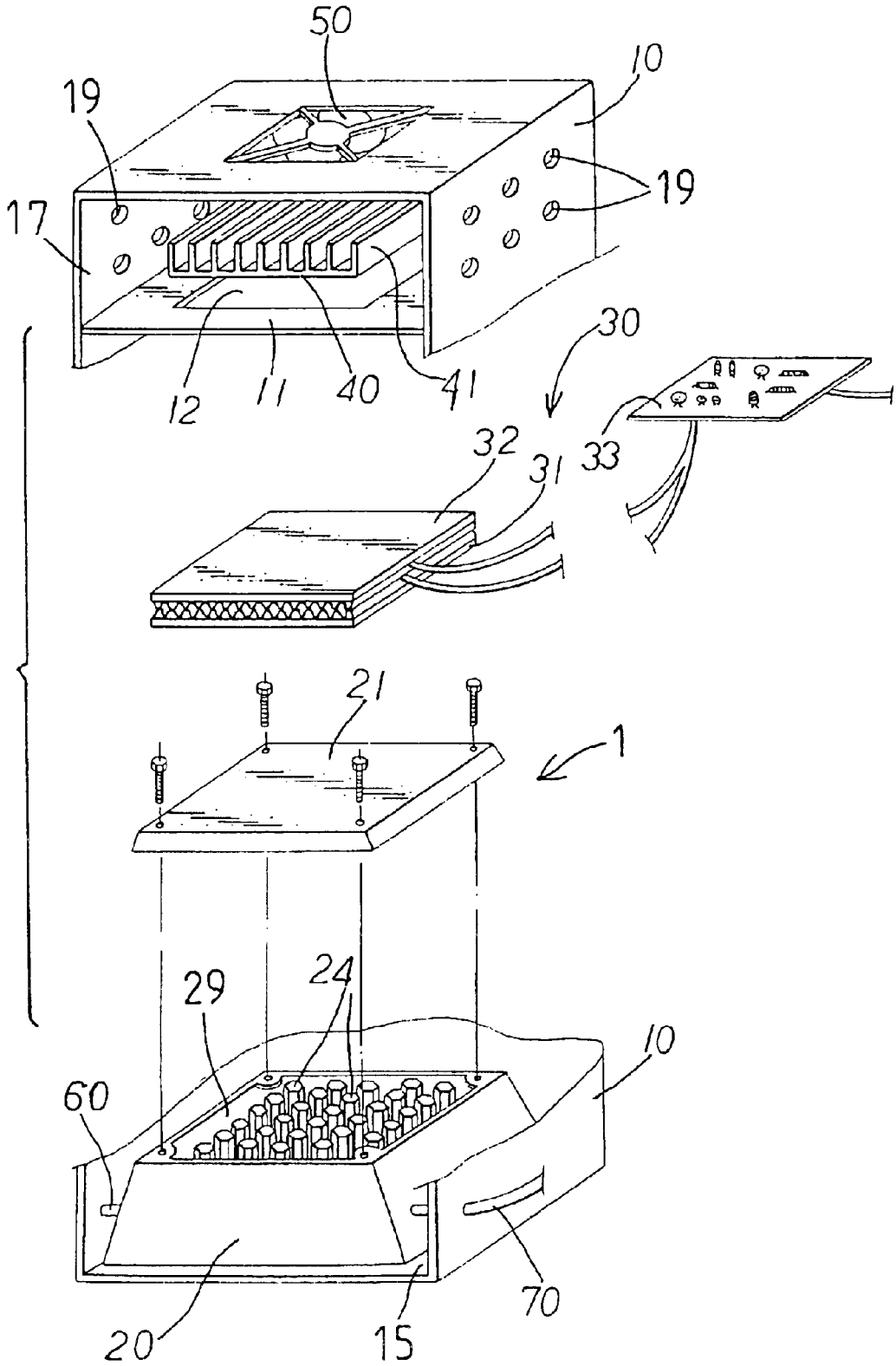
FIG. 5 is a partial exploded view illustrating another embodiment of the temperature regulator for the air mattress assembly.
Figure 7:
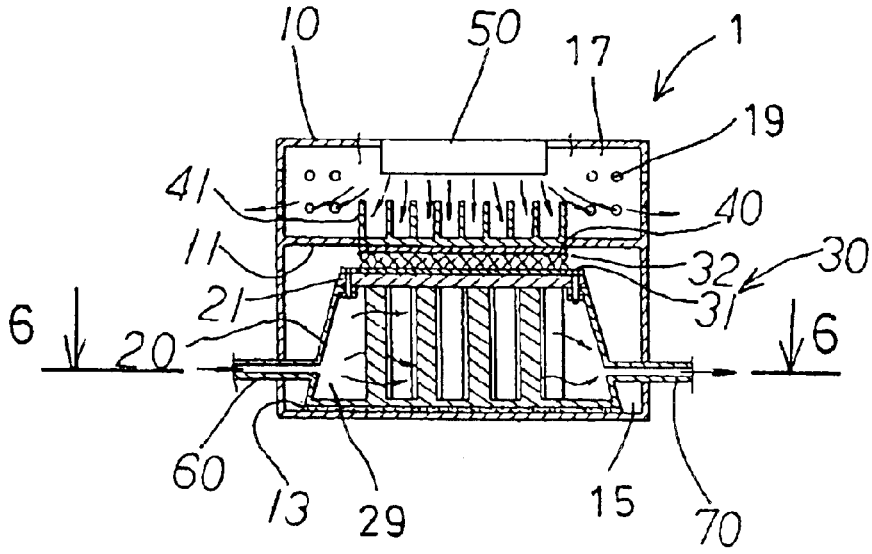
FIG. 7 is a cross sectional view taken along lines 7—7 of FIG. 6.
Figure 6:
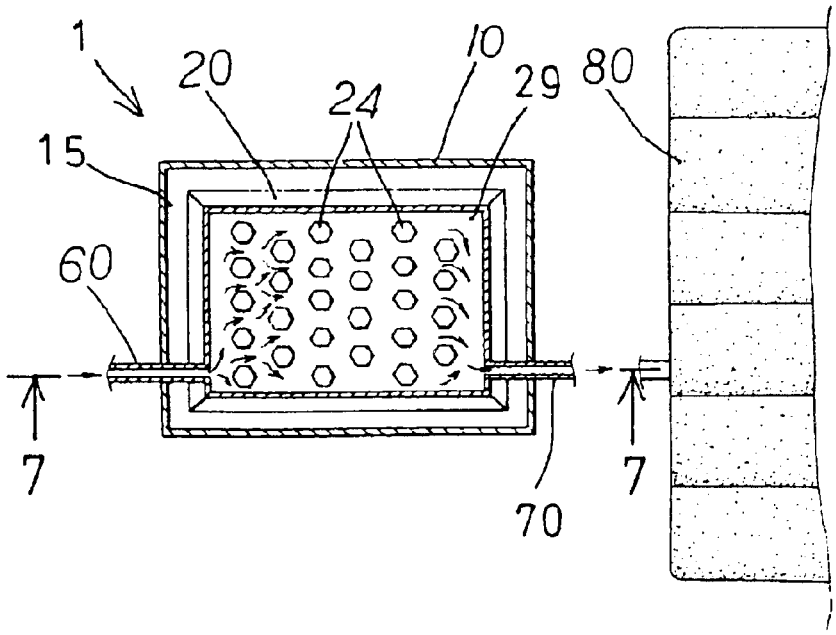
FIG. 6 is a cross sectional view taken along lines 6—6 of FIG. 7.

As shown in FIGS. 5–7, alternatively, instead of the heat exchanging members or the flaps 22, the casing 20 may include a number of posts 24 disposed therein, to allow the air to flow through the posts 24, and to absorb the heat of the air that flows through the posts 24.

Figure 8:
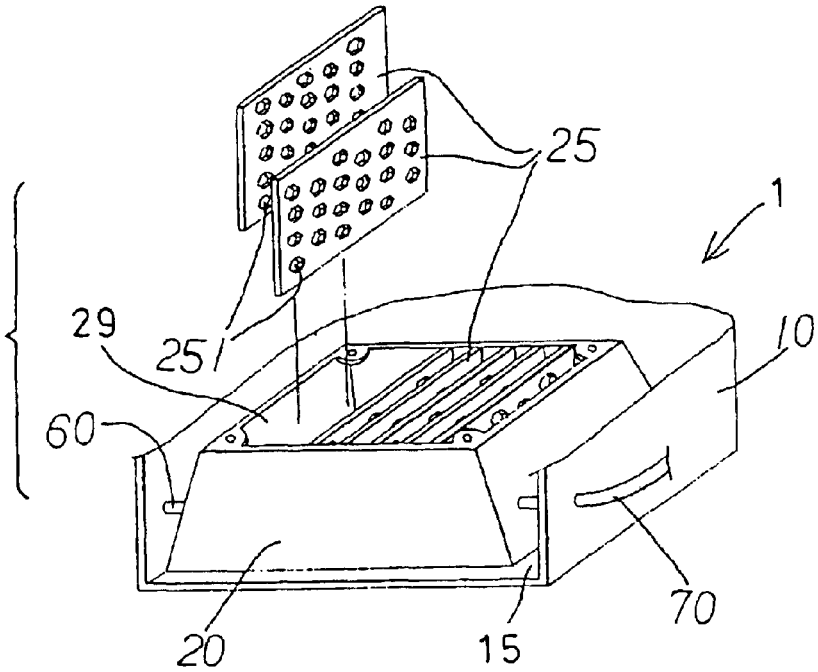
FIG. 8 is a partial exploded view illustrating a further embodiment of the temperature regulator for the air mattress assembly.
Figure 9:
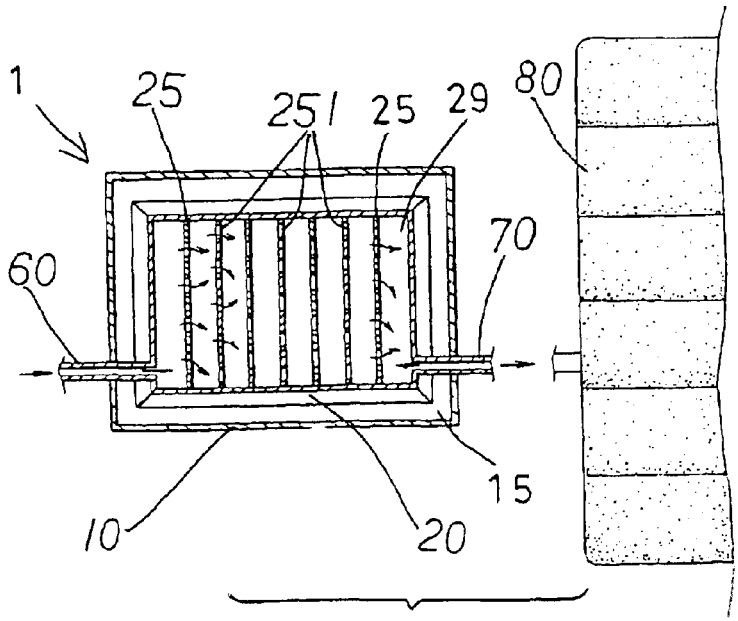
FIG. 9 is a cross sectional view of the temperature regulator as shown in FIG. 8.

As shown in FIGS. 8–9, further alternatively, instead of the heat exchanging members or the flaps 22 (FIGS. 2–4) and the posts 24 (FIGS. 5–7), the casing 20 may include a number of boards 25 disposed therein and each having a number of apertures 251 formed therein, to allow the air to flow through the apertures 251 of the boards 25, and to absorb the heat of the air that flows through the apertures 251 of the boards 25.

Figure 10:
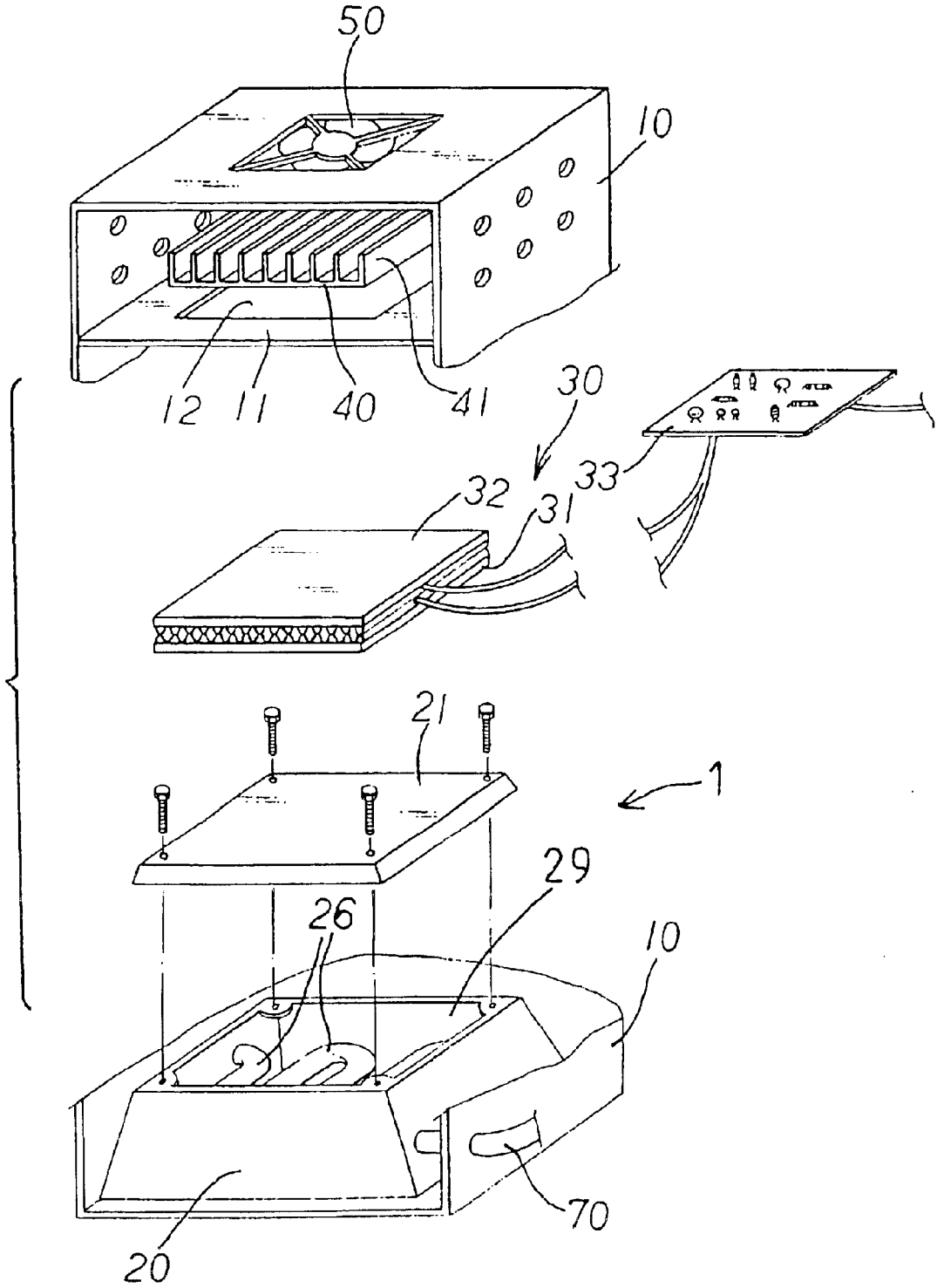
FIG. 10 is a partial exploded view illustrating a still further embodiment of the temperature regulator for the air mattress assembly.
Figure 11:
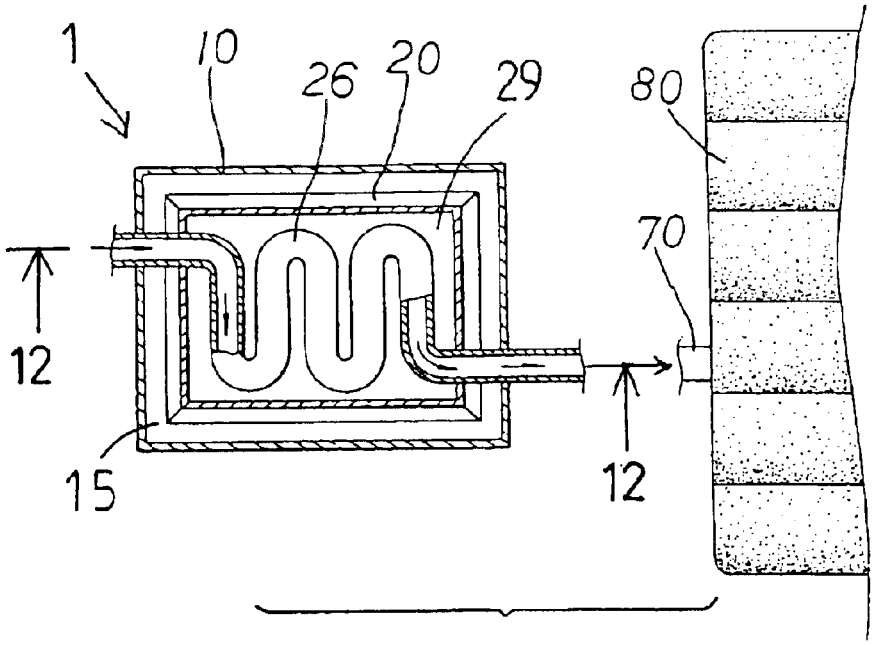
FIG. 11 is a cross sectional view of the temperature regulator as shown in FIG. 10, taken along lines 11—11 of FIG. 12.
Figure 12:
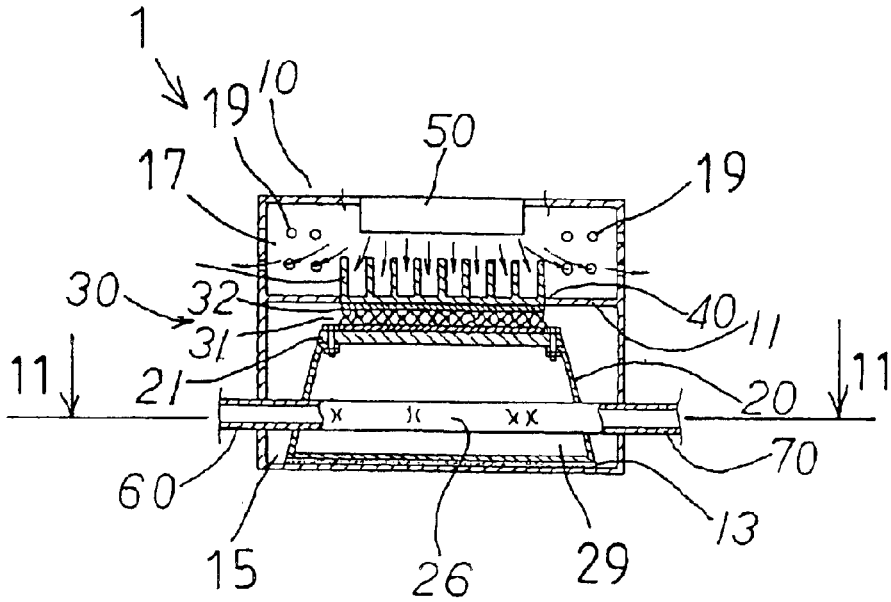
FIG. 12 is a cross sectional view taken along lines 12—12 of FIG. 12.

As shown in FIGS. 10–12, still further alternatively, instead of the flaps 22 (FIGS. 2–4) and the posts 24 (FIGS. 5–7) and the boards 25 (FIGS. 8–9), the casing 20 may include a zigzag-shaped manifold or conduit 26 disposed therein and coupled between the pipe 60 and the hose 70, to allow the air to flow through the conduit 26, and to absorb the heat of the air that flows through the conduit 26.

Figure 13:
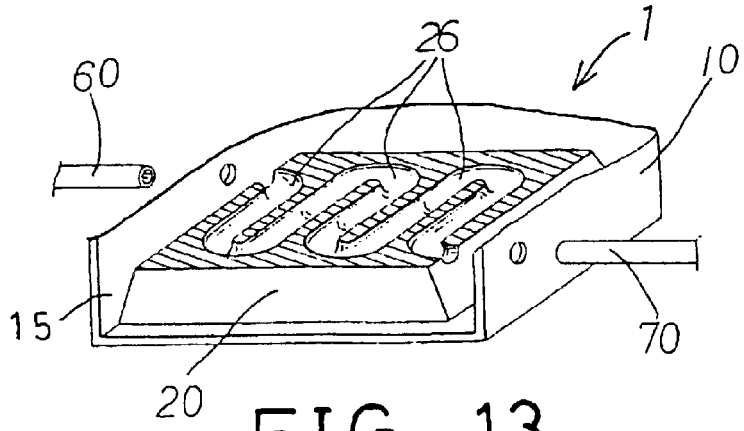
FIG. 13 is a partial exploded view illustrating a still further embodiment of the temperature regulator for the air mattress assembly.
Figure 14:
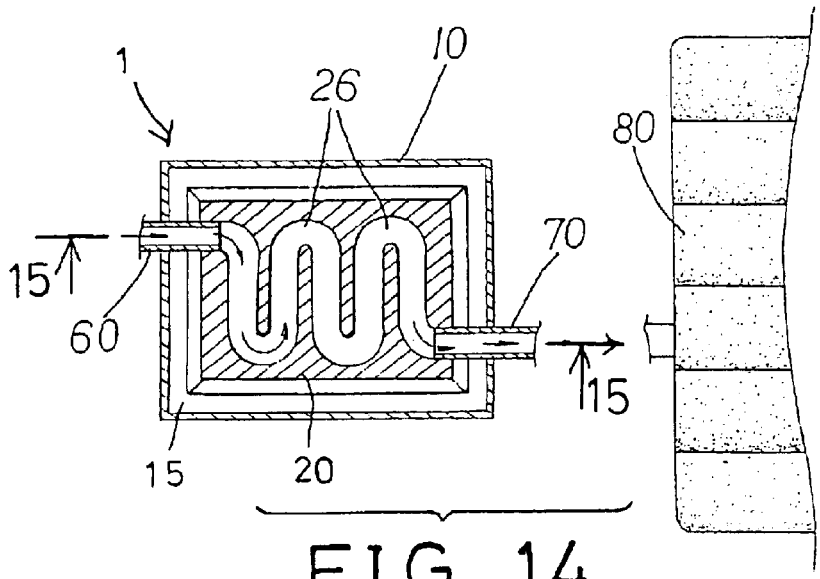
FIG. 14 is a cross sectional view of the temperature regulator as shown in FIG. 13, taken along lines 14—14 of FIG. 15.
Figure 15:
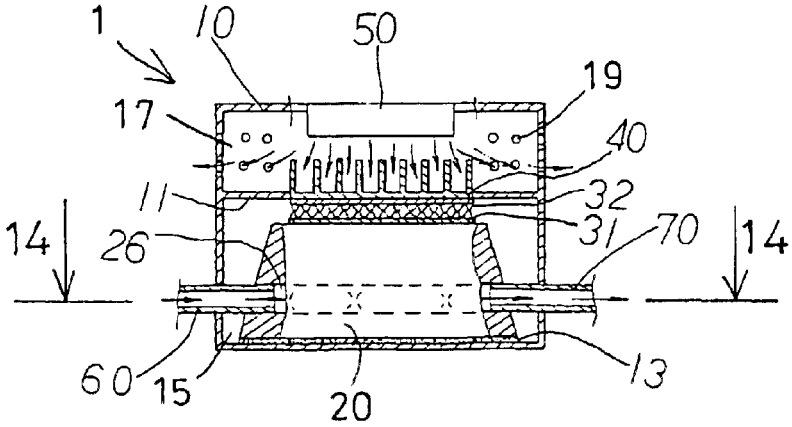
FIG. 15 is a cross sectional view taken along lines 15—15 of FIG. 14.

As shown in FIGS. 13–15, still further alternatively, instead of the flaps 22 (FIGS. 2–4) and the posts 24 (FIGS. 5–7) and the boards 25 (FIGS. 8–9), the casing 20 may include a zigzag-shaped manifold or conduit 26 that is directly formed within the casing 20, and coupled between the pipe 60 and the hose 70, to allow the air to flow through the conduit 26, and to absorb the heat of the air that flows through the conduit 26.

Figure 16:
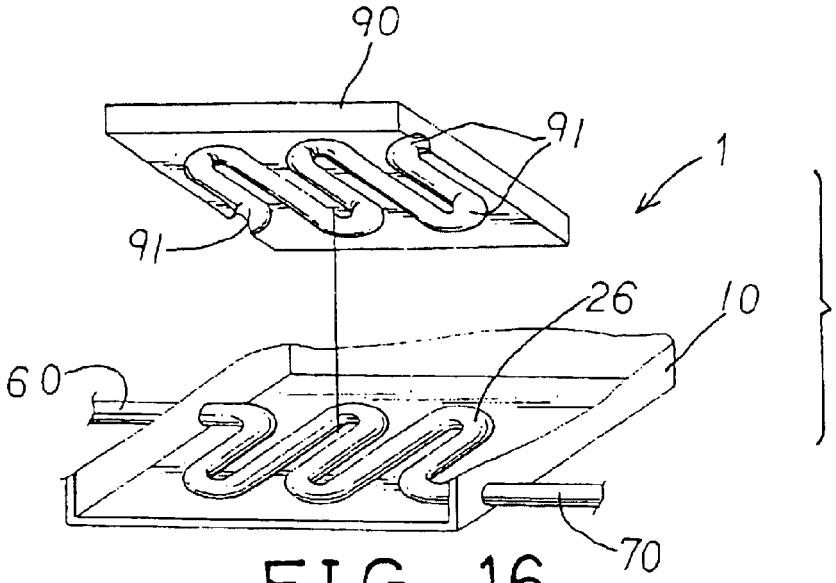
FIG. 16 is a partial exploded view illustrating a still further embodiment of the temperature regulator for the air mattress assembly.
Figure 17:
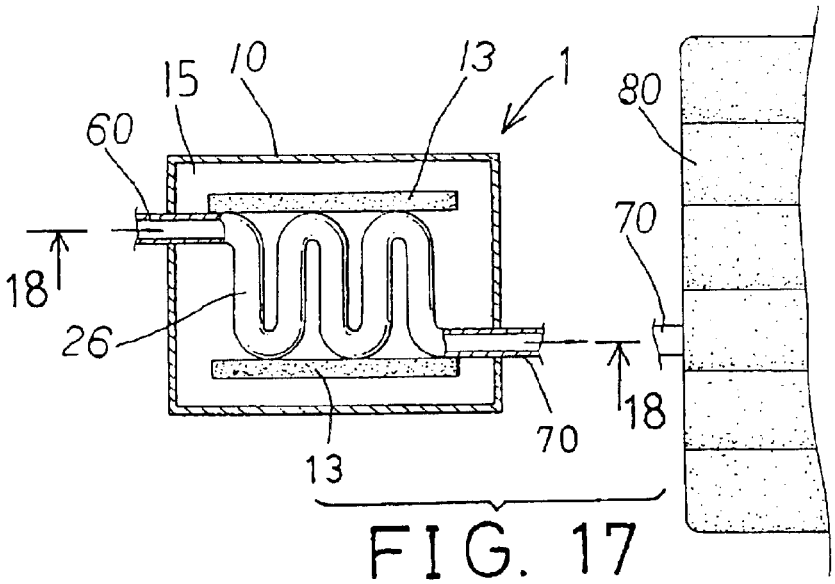
FIG. 17 is a cross sectional view of the temperature regulator as shown in FIG. 16, taken along lines 17—17 of FIG. 18.
Figure 18:
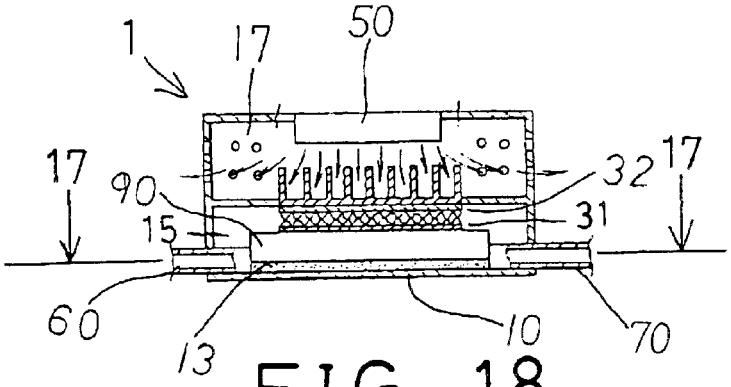
FIG. 18 is a cross sectional view taken along lines 18—18 of FIG. 17.

As shown in FIGS. 16–18, still further alternatively, instead of the flaps 22 (FIGS. 2–4) and the posts 24 (FIGS. 5–7) and the boards 25 (FIGS. 8–9), the casing 20 may include a zigzag-shaped manifold or conduit 26 coupled between the pipe 60 and the hose 70, to allow the air to flow through the conduit 26, and to absorb the heat of the air that flows through the conduit 26. A conductor plate 90 may further be provided and may include a recess 91 formed therein and having a shape corresponding to that of the conduit 26, in order to receive the conduit 26.

Alternatively, the semi-conductor chips or conductors 31, 32 of the heat exchanger 30 may be disposed up side down, and may have the conductor 31 engaged onto the heat dissipating device 40, in order to absorb the heat from the heat dissipating device 40, and may have the other conductor 32 engaged onto the cover 21 of the casing 20, in order to transmit the heat to the casing 20, and so as to heat the air flowing through the air passage 23 of the casing 20, and in order to supply the heated air to the air mattress member 80.

Accordingly, the air mattress assembly of the present invention includes a temperature regulator for adjusting the temperature of the air that flows into the air mattress member, and for allowing the air mattress member to comfortably support the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air mattress assembly comprising:

an air mattress member, and a temperature regulator coupled to said air mattress member with a hose, to regulate air and to supply the regulated air into said air mattress member via said hose, said temperature regulator including:

a housing having a partition attached therein to separate said housing into an upper chamber and a lower chamber, a casing disposed in said lower chamber of said housing, and including a pipe coupled to said casing to supply air into said casing and to allow the air to flow out of said casing via said hose, and a heat exchanging member disposed therein, to exchange heat with the air flowing into said casing, said heat exchanging member including a plurality of posts disposed in said casing, a heat dissipating device disposed in said upper chamber of said housing, a heat exchanger including two conductors disposed between said heat dissipating device and said casing, to transmit heat between said heat dissipating device and said casing, and a fan device disposed in said upper chamber of said housing, to generate and blow air through said heat dissipating device.

2. The air mattress assembly as claimed in claim 1, wherein said heat exchanging member includes a plurality of fins disposed in said casing.

3. The air mattress assembly as claimed in claim 1, wherein said heat exchanging member includes a manifold disposed in said casing, and coupled between said pipe and said hose.

4. The air mattress assembly as claimed in claim 3, wherein said housing includes a conductor plate disposed therein and having a recess formed therein to receive said mainfold.

5. An air mattress assembly comprising:

an air mattress member, and a temperature regulator coupled to said air mattress member with a hose, to regulate air and to supply the regulated air into said air mattress member via said hose, said temperature regulator including:

a housing having a partition attached therein to separate said housing into an upper chamber and a lower chamber, a casing disposed in said lower chamber of said housing, and including a pipe coupled to said casing to supply air into said casing and to allow the air to flow out of said casing via said hose, and a heat exchanging member disposed therein, to exchange heat with the air flowing into said casing, said heat exchanging member including a plurality of fins disposed in said casing, said fins being arranged in a zigzag-like air passage in said casing, a heat dissipating device disposed in said upper chamber of said housing, a heat exchanger including two conductors disposed between said heat dissipating device and said casing, to transmit heat between said heat dissipating device and said casing, and a fan device disposed in said upper chamber of said housing, to generate and blow air through said heat dissipating device.

6. An air mattress assembly comprising:

an air mattress member, and a temperature regulator coupled to said air mattress member with a hose, to regulate air and to supply the regulated air into said air mattress member via said hose, said temperature regulator including:

a housing having a partition attached therein to separate said housing into an upper chamber and a lower chamber, a casing disposed in said lower chamber of said housing, and including a pipe coupled to said casing to supply air into said casing and to allow the air to flow out of said casing via said hose, and a heat exchanging member disposed therein, to exchange heat with the air flowing into said casing, said heat exchanging member including a plurality of boards disposed in said casing and each having a plurality of apertures formed therein, a heat dissipating device disposed in said upper chamber of said housing, a heat exchanger including two conductors disposed between said heat dissipating device and said casing, to transmit heat between said heat dissipating device and said casing, and a fan device disposed in said upper chamber of said housing, to generate and blow air through said heat dissipating device.

* * * * *